US010590935B2

(12) United States Patent
Malvasi et al.

(10) Patent No.: US 10,590,935 B2
(45) Date of Patent: Mar. 17, 2020

(54) AUTOMOTIVE ELECTRIC LIQUID PUMP

(71) Applicant: PIERBURG PUMP TECHNOLOGY GMBH, Neuss (DE)

(72) Inventors: Alessandro Malvasi, Leghorn (IT); Giacomo Armenio, Leghorn (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 14/438,633

(22) PCT Filed: Oct. 29, 2012

(86) PCT No.: PCT/EP2012/071371
§ 371 (c)(1),
(2) Date: Apr. 27, 2015

(87) PCT Pub. No.: WO2014/067545
PCT Pub. Date: May 8, 2014

(65) Prior Publication Data

US 2015/0300355 A1 Oct. 22, 2015

(51) Int. Cl.
*F04D 13/06* (2006.01)
*F04D 7/00* (2006.01)
(Continued)

(52) U.S. Cl.
CPC ..... *F04D 13/06* (2013.01); *F01C 21/10* (2013.01); *F01C 21/108* (2013.01);
(Continued)

(58) Field of Classification Search
CPC .. F04D 13/06; F04D 7/00; F01C 21/10; F01C 21/108; F04C 11/008; F04C 15/008;
(Continued)

(56) References Cited

U.S. PATENT DOCUMENTS 3,695,791 A * 10/1972 Brundage ..... F04C 2/102 277/411
4,697,995 A * 10/1987 Tuckey ..... F04C 11/008 418/133

(Continued)

FOREIGN PATENT DOCUMENTS

CN 102472271 A 5/2012
EP 2 463 556 A1 6/2012

(Continued)

OTHER PUBLICATIONS

English Translation of JP-2000-209810 Al obtained Apr. 11, 2017.*
English Translation of JP 2009097503 obtained Oct. 18, 2017.*

*Primary Examiner* — Dominick L Plakkoottam
*Assistant Examiner* — Connor J Tremarche
(74) *Attorney, Agent, or Firm* — Norman B. Thot

(57) ABSTRACT

An automotive electric liquid pump includes a pump housing comprising a first longitudinal end and a second longitudinal end, a rotor which defines a longitudinal rotor axis, a pump chamber inlet, a pump chamber outlet, an electric motor, a power electronics chamber, a pump chamber, and a separation wall. The electric motor comprises stator coils arranged at the first longitudinal end. The electric motor drives a pump rotor. The power electronics chamber comprises power semiconductors to drive the stator coils. The power electronics chamber is arranged at the second longitudinal end. The pump chamber is configured to have the pump rotor driven by the electric motor rotate therein so as to pump a liquid from the pump chamber inlet to the pump chamber outlet. The separation wall is arranged in a transversal plane. The separating wall separates the pump chamber from the power electronics chamber.

16 Claims, 2 Drawing Sheets

(51) Int. Cl.
*F04C 15/06* (2006.01)
*F01C 21/10* (2006.01)
*F04C 15/00* (2006.01)
*F04C 11/00* (2006.01)

(52) U.S. Cl.
CPC ..... *F04C 11/008* (2013.01); *F04C 15/008* (2013.01); *F04C 15/0096* (2013.01); *F04C 15/06* (2013.01); *F04D 7/00* (2013.01); *F04C 2240/403* (2013.01); *F04C 2240/803* (2013.01); *F04C 2240/808* (2013.01)

(58) Field of Classification Search
CPC ..... F04C 15/0096; F04C 15/06; F04C 2240/403; F04C 2240/803; F04C 2240/808
USPC ..... 417/366
See application file for complete search history.

(56) References Cited

U.S. PATENT DOCUMENTS 5,542,829 A * 8/1996 Inagaki ..... F01C 17/06 418/55.3
6,280,167 B1 * 8/2001 Pahl ..... F04C 2/086 418/171
7,314,352 B2 * 1/2008 Nakayoshi ..... F04C 2/084 417/321
7,781,926 B2 * 8/2010 Schmidt ..... H02K 5/06 310/77
9,581,159 B2 * 2/2017 Sugihara ..... F04B 17/03
2004/0109772 A1 6/2004 Ogawa et al.
2004/0146414 A1 * 7/2004 Nichol ..... F01C 21/102 417/410.4
2004/0184940 A1 * 9/2004 Nakane ..... F04C 29/0092 418/55.1
2006/0222527 A1 * 10/2006 Kurita ..... F04C 14/26 417/410.1
2008/0118380 A1 * 5/2008 Nakanishi ..... F04D 13/064 417/423.1
2009/0104055 A1 * 4/2009 Satou ..... F04B 35/04 417/410.1
2009/0162221 A1 * 6/2009 Iguchi ..... F04C 23/008 417/410.1
2009/0175751 A1 * 7/2009 Nakayoshi ..... F04C 2/086 418/171
2010/0008797 A1 * 1/2010 Yukitake ..... F04C 2/102 417/310
2010/0111722 A1 * 5/2010 Schneider ..... F04C 2/084 417/352
2012/0128513 A1 5/2012 Sakata et al.
2012/0308414 A1 12/2012 Ogawa et al.

FOREIGN PATENT DOCUMENTS

JP 2000209810 A * 7/2000
JP 2009-97503 A 5/2009
JP 2009097503 A * 5/2009
WO WO 2012/035767 A1 3/2012

* cited by examiner

AUTOMOTIVE ELECTRIC LIQUID PUMP

CROSS REFERENCE TO PRIOR APPLICATIONS

This application is a U.S. National Phase application under 35 U.S.C. § 371 of International Application No. PCT/EP2012/071371, filed on Oct. 29, 2012. The International Application was published in English on May 8, 2014 as WO 2014/067545 A1 under PCT Article 21(2).

FIELD

The present invention is directed to an electric automotive liquid pump.

BACKGROUND

An electric automotive liquid pump is used to pump a liquid, for example, a coolant or a lubricant, to an automotive engine or to other automotive devices.

State of the art pumps are divided into three functional parts, namely, a motor section comprising an electric motor, a motor control electronics section, and a pumping section, whereby the motor section is provided longitudinally in the middle between the motor electronics section and the pumping section. This arrangement allows for a short electric connection between the motor electronics and the electric motor. The motor electronics comprise power semiconductors which must be cooled to avoid their overheating and destruction. The cooling of the power semiconductors in state of the art pumps is normally realized via the housing being cooled by the lubricant and by the environmental air outside of the pump housing. Since the liquid pumping section is, however, remote from the motor control electronics section, the liquid itself cannot help to cool the power semiconductors sufficiently and efficiently.

SUMMARY

An aspect of the present invention is to provide an electronic automotive liquid pump where the cooling of the power semiconductors is improved.

In an embodiment, the present invention provides an automotive electric liquid pump which includes a pump housing comprising a first longitudinal end and a second longitudinal end, a rotor which defines a longitudinal rotor axis, a pump chamber inlet, a pump chamber outlet, an electric motor, a power electronics chamber, a pump chamber, and a separation wall. The electric motor comprises stator coils arranged at the first longitudinal end of the pump housing. The electric motor is configured to drive a pump rotor. The power electronics chamber comprises power semiconductors configured to drive the stator coils. The power electronics chamber is arranged at the second longitudinal end of the pump housing. The pump chamber is configured to have the pump rotor driven by the electric motor rotate therein so as to pump a liquid from the pump chamber inlet to the pump chamber outlet. The separation wall is arranged in a transversal plane. The separating wall is configured to separate the pump chamber from the power electronics chamber.

BRIEF DESCRIPTION OF THE DRAWINGS

The present invention is described in greater detail below on the basis of embodiments and of the drawings in which.

DETAILED DESCRIPTION

Figure 1:
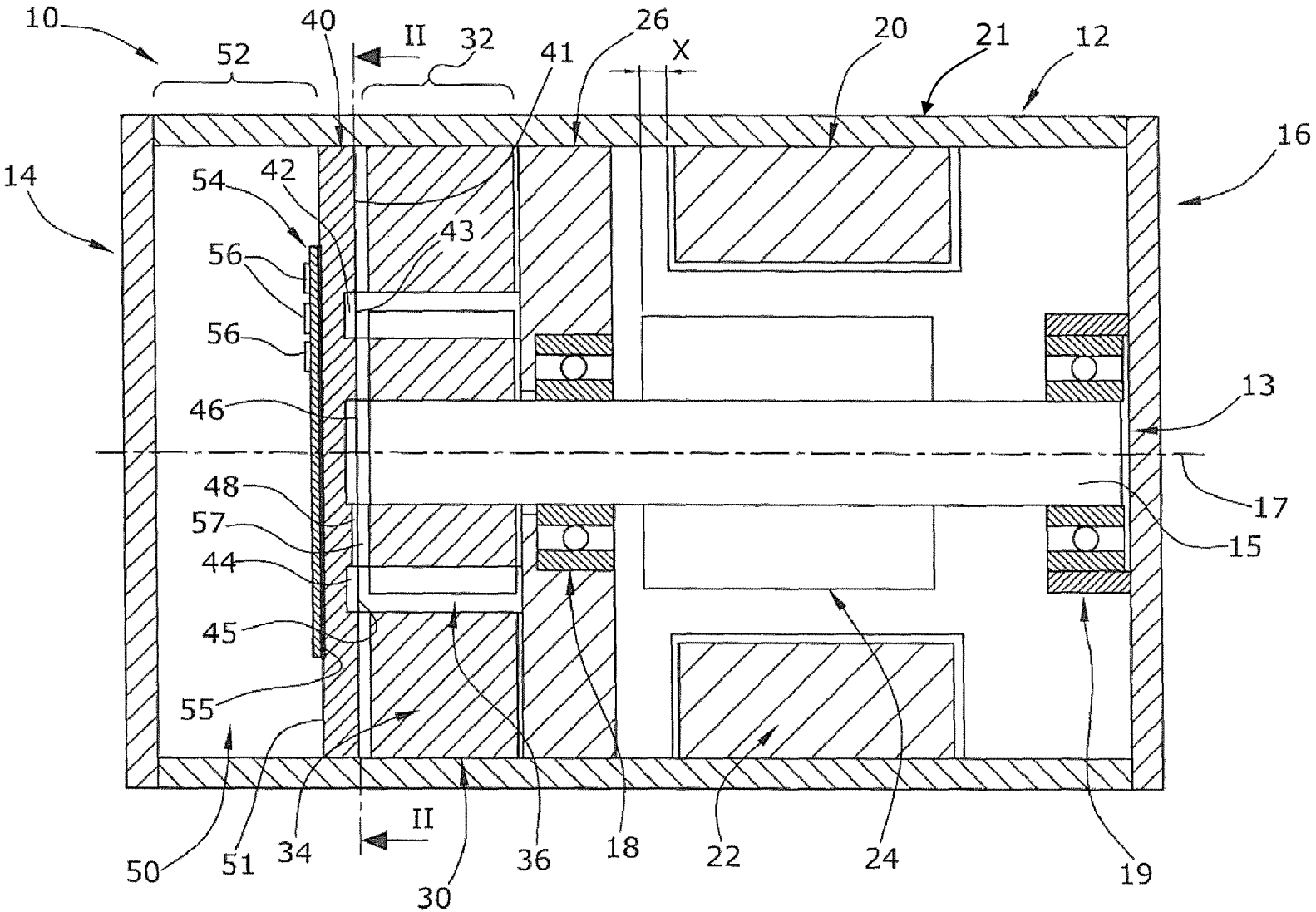
FIG. 1 shows a schematic longitudinal section of an automotive electric liquid pump including a separation wall separating a pump chamber from a power electronics chamber.

The electric automotive liquid pump of the present invention is provided with a pump housing and a rotor which defines the longitudinal axis of the pump. The pump comprises an electric motor including stator coils arranged at one longitudinal end of the pump housing, and not arranged axially between two other sections. A power electronics chamber is provided and defined in the pump housing, whereby the power electronics chamber is provided with power semiconductors for electrically driving the stator coils of the pump rotor. The power electronics chamber is arranged at the other longitudinal end of the pump housing and is not arranged between the other two sections. A pumping chamber is provided between the power electronics chamber at one longitudinal pump end and the electric motor arranged at the other longitudinal pump end, wherein a pump rotor driven by the electric motor via a rotor shaft rotates to pump a liquid from a pump chamber inlet to a pump chamber outlet. In other words, the pumping chamber comprising the pump rotor is arranged between the power electronics chamber at one longitudinal side and the electric motor at the longitudinal other side. The pumping chamber is not necessarily arranged in the geometric longitudinal middle of the pump housing.

The pumping chamber and the power electronics chamber are separated by a separation wall made of metal which lies in a transversal plane with respect to the longitudinal axis. Since the separation wall defines one wall of the pump chamber comprising the pumped liquid, the separation wall is always cooled by the liquid with a high cooling performance. The total distance between the liquid in the pump chamber and the power semiconductors is also very short, and can be as short as a few millimeters. Since the maximum temperature of a coolant or a lubricant in an automotive application never is higher than 120° C., this arrangement provides that the separation wall will, under normal circumstances, also not become warmer than 120° C. Since power semiconductors with a maximum working temperature of 140° C. up to 150° C. are available, an overheating of these power semiconductors can reliably be excluded.

In an embodiment of the present invention, the power semiconductors can, for example, be provided so as to be in a heat-conduction connection with the separation wall. This does not necessarily mean that the power semiconductors are directly in contact with the separation wall. The power semiconductors must, however, be connected with the separation wall without an air gap existing between the semiconductor and the separation wall.

In an embodiment of the present invention, the power semiconductors can, for example, be connected to the separation wall only via materials with good heat-conduction abilities, such as, for example, a metal, a heat-conductive paste, and/or a heat-conductive glue or adhesive.

In an embodiment of the present invention, the pump chamber inlet can, for example, be realized as a recess in the plane separation wall surface facing the pump chamber. This feature leads to an increased total surface area so that the heat exchange between the liquid in the pump chamber and the separation wall is improved. The liquid flowing into the pump chamber through the pump chamber inlet also leads to an increased turbulence in the liquid close and adjacent to the separation wall, which also increases the heat exchange between the liquid in the pump chamber and the separation wall.

In an embodiment of the present invention, the pump chamber outlet can, for example, be realized as a recess in the plane surface of the separation wall. This has the same effects and results as it is the case with the pump chamber inlet recess.

In an embodiment of the present invention, the power semiconductors can, for example, be arranged closer to the pump chamber inlet then to the pump chamber outlet. The region around and exactly opposite to the pump chamber inlet is the coldest region of the separation wall because of the increased total surface area, the increased liquid turbulence in this region, and the fact that the incoming liquid is colder than the liquid flowing out of the pump chamber through the pump chamber outlet. The incoming liquid is colder because the pressurized liquid leaving the pump chamber is warmed by the thermodynamic effect caused by the increased liquid pressure at the chamber outlet. The cooling performance close to the pump chamber inlet is therefore the highest cooling performance available at the separation wall.

In an embodiment of the present invention, a center recess or pocket can, for example, be provided in the radial center of the separation wall, whereby the center recess is provided axially opposite to the rotor shaft and/or to the pump rotor. This feature increases the total surface area of the separation wall surface facing the pump chamber so that the heat exchange between the liquid in the pump chamber and the separation wall is increased.

In an embodiment of the present invention, the center recess can, for example, be fluidically connected to the pump chamber outlet. The liquid pressure in the pump chamber outlet is higher than in the pump chamber so that the liquid pressure in the center recess pushes the opposite rotor shaft and/or the opposite pump rotor away from the separation wall. A significant gap filled with the liquid is generated as a result, whereby the liquid in the gap is highly turbulent as long as the rotor shaft and the pump rotor rotate so that an intensive heat exchange is realized in this area between the liquid in the pump chamber and the separation wall. The fluidic connection between the pump chamber outlet and the center recess can, for example, be realized by a connection channel recess in the separation wall.

In an embodiment of the present invention, the motor stator coils can, for example, be axially offset with respect to the motor rotor to pull the rotor shaft and the pump rotor axially away from the separation wall. A significant transversal gap filled with the liquid is generated as a result as long as the electric motor is electrically active, the gap being defined between the rotor shaft and/or the pump rotor at one side, and the separation wall at the other side. This leads to a dramatically improved heat exchange between the liquid and the separation wall in this area.

The liquid pump is generally realized as a positive displacement pump, such as a screw compressor, a vane pump etc. The liquid pump can, for example, be realized as a lubricant pump. The pump can, for example, be a gerotor pump rotor.

An embodiment of the present invention is described below under reference to the drawings.

Figure 2:
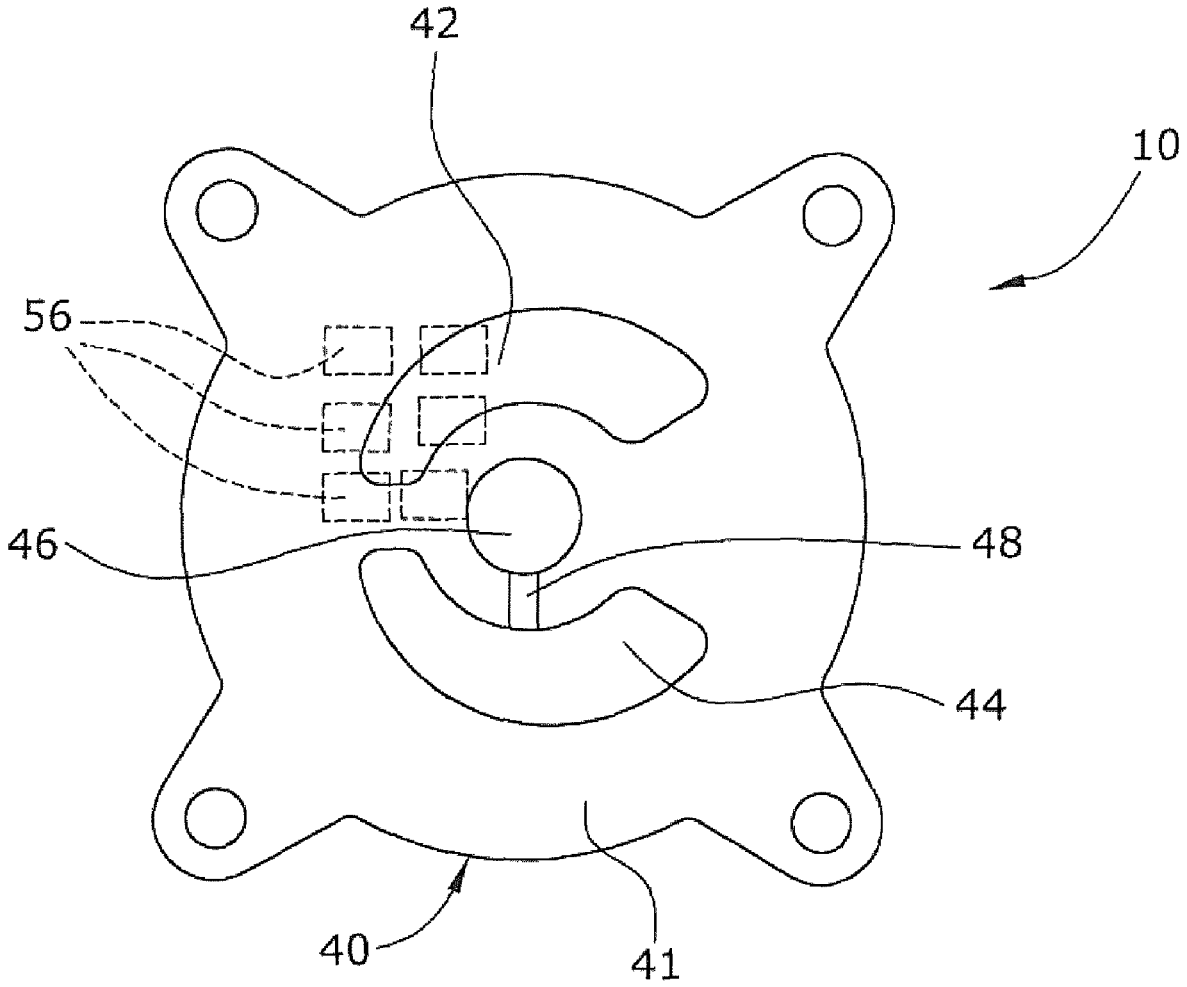
FIG. 2 shows a cross section II-II of the pump of FIG. 1 showing the surface of the separation wall facing the pump chamber.

FIGS. 1 and 2 show an automotive electric liquid pump 10 which is realized as a lubricant pump for providing a pressurized lubricant for an automotive internal combustion engine.

The pump 10 comprises a pump housing 12 which houses, seen in longitudinal direction, three sections, i.e., an electric motor 20 at one longitudinal pump end, a power electronics chamber 50 defining an electronics section 52 at the other longitudinal pump end, and a pump chamber 30 defining a pump section 32 being arranged between the power electronics chamber 50 and the electric motor 20. The pump 10 is provided with a rotor 13 comprising a rotor shaft 15 defining a longitudinal rotor axis 17. The rotor shaft 15 is rotatably supported by two roller bearings 18, 19 at the pump housing 12. The pump housing 12 substantially comprises a housing cylinder 21 which is closed by separate covers 14, 16 at both longitudinal ends of the pump housing 12.

The electric motor 20 is a brushless DC motor which is electronically commutated by a motor control electronics provided in the power electronics chamber 50. The electric motor 20 is provided with a permanent magnetic motor rotor 24 and with stator coils 22 which are electrically driven by several power semiconductors 56 arranged in the power electronics chamber 50.

A first transversal separation wall 26 separates the motor section from the pump section 32 with the pump chamber 30. An inner pump rotor 36 and an outer pump rotor 34 are provided in the pump chamber 30, both defining a gerotor pumping the lubricant from a pump chamber inlet 43 to a pump chamber outlet 45.

A second transversal separation wall 40 made of metal separates the pump chamber 30 from the electronics section 52 including the power electronics chamber 50 so as to be fluid-tight. The second transversal separation wall 40 is provided with a first plane surface 41 facing the pump chamber 30, and a second plane surface 51 facing the power electronics chamber 50. The second transversal separation wall 40 is provided with several recesses at the first plane surface 41 which are shown in FIG. 2 in plan view. The lateral pump chamber inlet 43 is defined by a sickle-shaped inlet recess 42, and the lateral pump chamber outlet 45 is defined by another sickle-shaped outlet recess 44.

The center of the second plane surface 51 is provided with a center recess 46 which is fluidically connected to the pump chamber outlet 45 by a radial connection channel recess 48 in the second transversal separation wall 40. The fluid pressure at the pump chamber outlet 45 is normally the highest of all pump chamber regions. Since the center recess 46 is fluidically connected with the pump chamber outlet 45, the high fluid pressure at the pump chamber outlet 45 is also present at the center recess 46. The rotor shaft 15 and the inner pump rotor 36 are as a result pushed away from the second transversal separation wall 40 so that a significant gap 57 between the rotor shaft 15, including the inner pump rotor 36 at one side, and the separation wall surface 41 facing the pump chamber 30 at the other side, is always realized. This gap 57 is filled with the pump liquid which is a lubricant in the present embodiment.

As can be seen in FIG. 1, the stator coils 22 are longitudinally offset with an offset X with respect to the permanent magnetic motor rotor 24. If the stator coils 22 are energized, the permanent magnetic motor rotor 24 and the connected rotor shaft 15 including the inner pump rotor 36 are axially pulled away from the second transversal separation wall 40 separating the power electronics chamber 50 from the pump chamber 30 to create the liquid-filled gap 57. The liquid-filled gap 57 avoids a frictional contact between the rotating parts of the rotor 13 and the second transversal separation wall 40, and leads to an improved heat exchange between the liquid in the pump chamber 30 and the second transversal separation wall 40.

The power semiconductors 56 are mounted to a printed circuit board 54 which also comprise the control electronics to control the power semiconductors 56. The power semiconductors 56 can, for example, be power MOSFETs, or any other kind of power semiconductors. The backside of the printed circuit board 54 is connected with the second transversal separation wall 40 by a layer 55 of a heat-conductive glue or adhesive so that a heat-conductive connection and coupling is provided between the power semiconductors 56 and the second transversal separation wall 40.

As can be seen in FIG. 2, the power semiconductors 56 are all provided opposite and next to the pump chamber inlet 43 rather than to the pump chamber outlet 45. Since the temperature of the liquid is generally lower at the pump chamber inlet 43, the arrangement of the power semiconductors 56 close to the pump chamber inlet 43 leads to an improved cooling of the power semiconductors 56.

The present invention is not limited to embodiments described herein; reference should be had to the appended claims.

What is claimed is:

1. An automotive electric liquid pump comprising:

a pump housing comprising a first longitudinal end and a second longitudinal end;

a rotor which defines a longitudinal rotor axis;

a pump chamber inlet;

a pump chamber outlet;

an electric motor comprising stator coils arranged within the first longitudinal end of the pump housing, the electric motor being configured to drive a pump rotor;

a power electronics chamber comprising power semiconductors configured to drive the stator coils, the power electronics chamber being arranged within the second longitudinal end of the pump housing;

a pump chamber configured to have the pump rotor driven by the electric motor rotate therein so as to pump a liquid from the pump chamber inlet to the pump chamber outlet, the pump chamber being arranged within the pump housing between the electric motor arranged within the first longitudinal end of the pump housing and the power electronics chamber arranged within the second longitudinal end of the pump housing;

a first separation wall arranged in a first transversal plane, the first separation wall being configured to separate the pump chamber from the power electronics chamber; and a second separation wall arranged in a second transversal plane, the second separation wall being configured to separate the pump chamber from the electric motor, wherein, the power semiconductors are arranged so as to be in a heat-conduction connection with the first separation wall.

2. The automotive electric liquid pump as recited in claim 1, wherein the first separation wall comprises a plane surface, and the pump chamber inlet is provided as a recess in the plane surface of the first separation wall.

3. The automotive electric liquid pump as recited in claim 1, wherein the first separation wall comprises a plane surface, and the pump chamber outlet is provided as a recess in the plane surface of the first separation wall.

4. The automotive electric liquid pump as recited in claim 1, wherein the power semiconductors are arranged so as to be closer to the pump chamber inlet than to the pump chamber outlet.

5. The automotive electric liquid pump as recited in claim 1, further comprising:

a rotor shaft, wherein, the first separation wall comprises a center recess arranged in a middle of the first separation wall and axially opposite to at least one of the rotor shaft and the pump rotor.

6. The automotive electric liquid pump as recited in claim 5, wherein the center recess is fluidically connected to the pump chamber outlet.

7. The automotive electric liquid pump as recited in claim 6, wherein the first separation wall further comprises a connection channel recess, the connection channel recess being configured to connect the center recess with the pump chamber outlet.

8. The automotive electric liquid pump as recited in claim 1, further comprising:

a motor rotor, wherein the stator coils are arranged so as to be axially offset with respect to the motor rotor so as to pull the pump rotor axially away from the first separation wall.

9. The automotive electric liquid pump as recited in claim 1, wherein the automotive electric liquid pump is a lubricant pump.

10. The automotive electric liquid pump as recited in claim 1, wherein the pump rotor is a gerotor-type pump rotor.

11. The automotive electric liquid pump as recited in claim 1, wherein the first separation wall is a metal separation wall.

12. The automotive electric liquid pump as recited in claim 1, wherein the second separation wall comprises a bearing for the rotor.

13. The automotive electric liquid pump as recited in claim 1, wherein each of the first separation wall and the second separation wall are configured to directly contact and to extend from the pump housing.

14. An automotive electric liquid pump comprising:

a pump housing comprising a first longitudinal end and a second longitudinal end;

a rotor which defines a longitudinal rotor axis;

a pump chamber inlet;

a pump chamber outlet;

an electric motor comprising stator coils arranged within the first longitudinal end of the pump housing, the electric motor being configured to drive a pump rotor;

a power electronics chamber comprising power semiconductors configured to drive the stator coils, the power electronics chamber being arranged within the second longitudinal end of the pump housing;

a pump chamber configured to have the pump rotor driven by the electric motor rotate therein so as to pump a liquid from the pump chamber inlet to the pump chamber outlet, the pump chamber being arranged within the pump housing entirely between the electric motor arranged within the first longitudinal end of the pump housing and the power electronics chamber arranged within the second longitudinal end of the pump housing;

a first separation wall arranged in a first transversal plane, the first separation wall being configured to separate the pump chamber from the power electronics chamber; and a second separation wall arranged in a second transversal plane, the second separation wall being configured to separate the pump chamber from the electric motor, wherein the power semiconductors are arranged so as to be in a heat-conduction connection with the first separation wall.

15. The automotive electric liquid pump as recited in claim 14, wherein the second separation wall comprises a bearing for the rotor.

16. The automotive electric liquid pump as recited in claim 14, wherein each of the first separation wall and the second separation wall are configured to directly contact and to extend from the pump housing.

* * * * *